US006932877B2

(12) United States Patent
Raymond et al.

(10) Patent No.: US 6,932,877 B2
(45) Date of Patent: Aug. 23, 2005

(54) QUASI-ISOTHERMAL FORGING OF A NICKEL-BASE SUPERALLOY

(75) Inventors: Edward Lee Raymond, Maineville, OH (US); Richard Gordon Menzies, Wyoming, OH (US); Terrence Owen Dyer, Cincinnati, OH (US); Barbara Ann Link, West Chester, OH (US); Richard Frederick Halter, Mason, OH (US); Mike Eugene Mechley, Cincinnati, OH (US); Francis Mario Visalli, Mason, OH (US); Shesh Krishna Srivatsa, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 180 days.

(21) Appl. No.: 10/286,579

(22) Filed: Oct. 31, 2002

(65) Prior Publication Data

US 2004/0084118 A1 May 6, 2004

(51) Int. Cl.[7] ..... C22F 1/10
(52) U.S. Cl. ..... 148/677; 148/676
(58) Field of Search ..... 148/676, 677

(56) References Cited

U.S. PATENT DOCUMENTS 3,660,177 A * 5/1972 Brown et al. ..... 148/677
3,802,938 A * 4/1974 Collins et al. ..... 419/28
4,740,354 A 4/1988 Watanabe et al.
5,120,373 A * 6/1992 Miller et al. ..... 148/564
5,547,523 A 8/1996 Blankenship, Jr. et al.
5,649,280 A 7/1997 Blankenship et al.
5,759,305 A 6/1998 Benz
2004/0084118 A1 * 5/2004 Raymond et al. ..... 148/676

FOREIGN PATENT DOCUMENTS

GB 1 253 861 A 11/1971

OTHER PUBLICATIONS

Metals Handbook (10$^{th}$ Edition) vol. 1, Prperties and Selection: Irons, Steels, and High Performance Alloys, 1990, pp. 950, 951, 970 and 982.*

* cited by examiner

*Primary Examiner*—John P. Sheehan
(74) *Attorney, Agent, or Firm*—McNees Wallace & Nurick LLC

(57) ABSTRACT

A forging blank of a forging nickel-base superalloy is forged in a forging press having forging dies made of a die nickel-base superalloy. The forging is accomplished by heating the forging blank to a forging-blank starting temperature of from about 1850° F. to about 1950° F., heating the forging dies to a forging-die starting temperature of from about 1500° F. to about 1750° F., placing the forging blank into the forging press and between the forging dies, and forging the forging blank at the forging-blank starting temperature using the forging dies at the forging-die starting temperature, to produce a forging.

17 Claims, 2 Drawing Sheets

QUASI-ISOTHERMAL FORGING OF A NICKEL-BASE SUPERALLOY

This invention relates to the forging of nickel-base superalloys and, more particularly, to such forging conducted in air.

BACKGROUND OF THE INVENTION

Nickel-base superalloys are used in the portions of aircraft gas turbine engines which have the most demanding performance requirements and are subjected to the most adverse environmental conditions. Cast nickel-base superalloys are employed, for example, as turbine blades and turbine vanes. Wrought nickel-base superalloys are employed, for example, as rotor disks and shafts. The present invention is concerned with the wrought nickel-base superalloys.

The wrought nickel-base superalloys are initially supplied as cast-and-consolidated billets, which are cast from molten metal, or as consolidated-powder billets, which are consolidated from powders. The consolidated-powder billets are preferred as the starting material for many applications because they have a uniform, well-controlled initial structure and a fine grain size. In either case, the billet is reduced in size in a series of steps by metal working procedures such as forging or extrusion, and is thereafter machined. In a simplest form of forging, the billet is placed between two forging dies in a forging press. The forging dies are forced together by the forging press to reduce the thickness of the billet.

The selection of the forging conditions depends upon several factors, including the properties and metallurgical characteristics of the nickel-base superalloy and the properties of the forging dies. The forging dies must be sufficiently strong to deform the material being forged, and the forged superalloy must exhibit the required properties at the completion of the forging and heat treat operations.

At the present time, nickel-base superalloys such as Rene™ 95 are isothermally forged at a temperature at or above about 1900° F.–2000° F. using TZM molybdenum dies. This combination of the superalloy being forged and the die material allows the forging to be performed, and the superalloy has the required properties at the completion of the forging and heat treatment. However, this combination of temperature, the superalloy being forged, and the die material requires that the forging procedure be conducted in vacuum or in an inert-gas atmosphere. The requirement of a vacuum or an inert-gas atmosphere greatly increases the complexity and cost of the forging process.

There is a need for an improved approach to the forging of nickel-base superalloys that achieves the required properties and also reduces the forging cost. The present invention fulfills this need, and further provides related advantages.

BRIEF SUMMARY OF THE INVENTION

The present invention provides a method for forging nickel-base superalloys such as Rene™ 95. The method allows the forging procedure to be performed in air, resulting in a substantial cost saving. The forging is also relatively rapid, reducing the cost. The final microstructure has the desired grain structure, and in most cases no supersolvus final annealing is required so that there is no concern with critical grain growth (CGG).

A method for forging a superalloy comprises the steps of providing a forging blank of a forging nickel-base superalloy, and providing a forging press having forging dies made of a die nickel-base superalloy. The forging blank is heated to a forging-blank starting temperature of from about 1850° F. to about 1950° F. (most preferably about 1900° F.), and the forging dies are heated to a forging-die starting temperature of from about 1500° F. to about 1750° F. (most preferably about 1700° F.). The forging blank is placed into the forging press and between the forging dies, and forged at the forging-blank starting temperature using the forging dies at the forging-die starting temperature, to produce a forging such as a precursor of a component of a gas turbine engine. Examples of such components include rotor disks and shafts. The heating steps and the forging step are all preferably performed in air. The forging is preferably performed at a relatively high strain rate of at least, and preferably greater than, about 0.02 per second.

The forging blank is preferably made of Rene™ 95 alloy, having a nominal composition, in weight percent, of about 8 percent cobalt, about 14 percent chromium, about 3.3 percent molybdenum, about 3.5 percent tungsten, about 3.5 percent aluminum, about 2.5 percent titanium, about 3.5 percent niobium, about 0.05 percent zirconium, about 0.07 percent carbon, about 0.01 percent boron, balance nickel and minor elements. The forging blank may be provided as consolidated powder or as cast-and-wrought material.

The forging dies may be made of any operable cast die nickel-base alloy such as a nickel-base superalloy, but preferably have a nominal composition, in weight percent, of from about 5 to about 7 percent aluminum, from about 8 to about 15 percent molybdenum, from about 5 to about 15 percent tungsten, up to about 140 parts per million magnesium (preferably about 140 parts per million magnesium), no rare earths, balance nickel and impurities.

Desirably, there is no supersolvus annealing of the forging, after the step of forging.

The forging nickel-base superalloy is forged by the present approach into a forging that has essentially the same fine-grained, uniform microstructure as an isothermal forging, without any critical grain growth. The forging is accomplished rapidly, with the forging dies at a significantly lower temperature than the forging blank.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
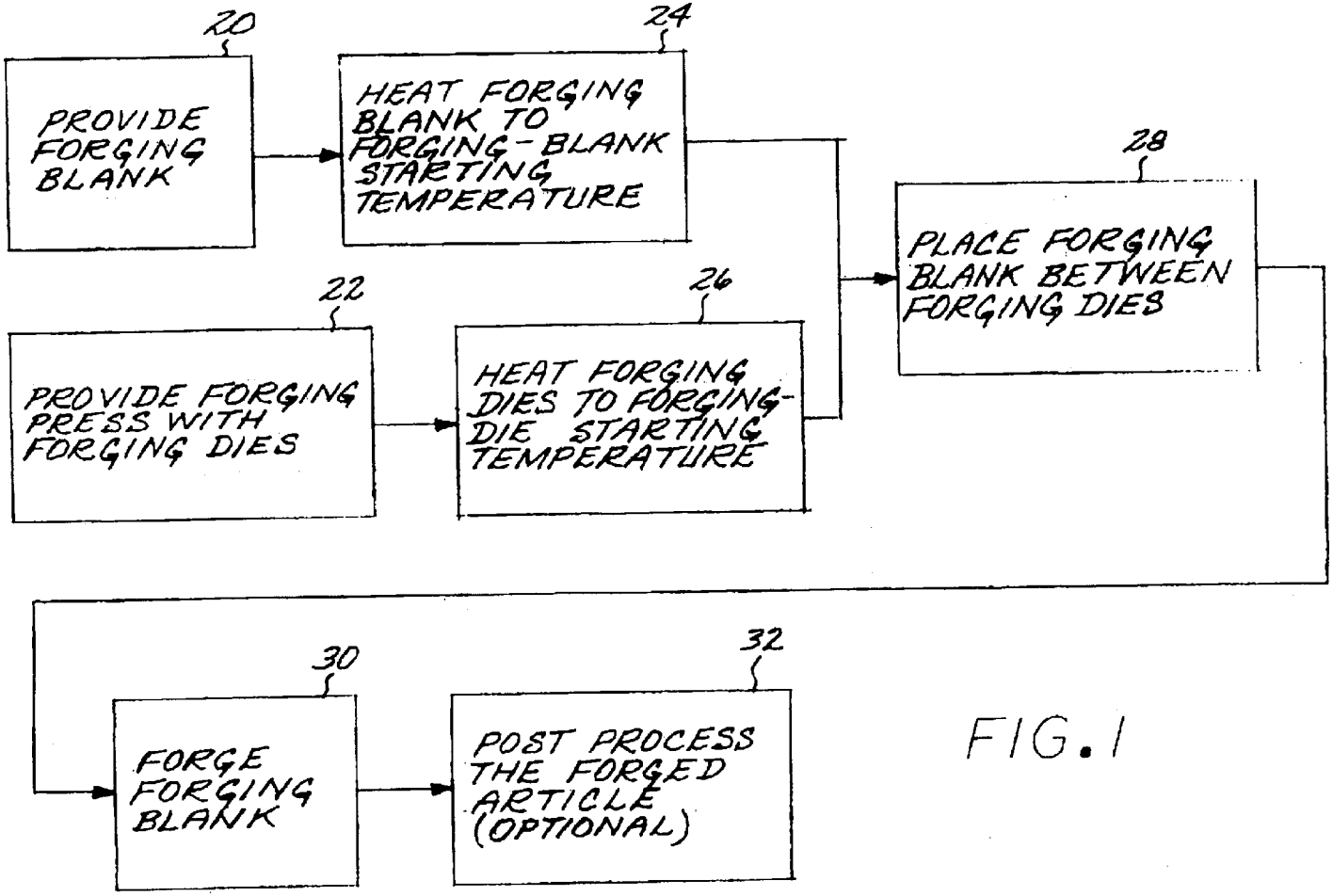
FIG. 1 is a block flow diagram of an approach for practicing the invention.

FIG. 1 depicts a preferred approach for practicing the invention. A forging blank is provided, step 20. The forging blank is made of a forging nickel-base alloy and preferably a forging nickel-base superalloy. As used herein, an alloy is nickel-base when it has more nickel than any other element, and is further a nickel-base superalloy when it is strengthened by the precipitation of gamma prime or related phases.

Any operable forging nickel-base alloy may be used. A nickel-base superalloy of particular interest as the forging blank is Rene™ 95 alloy, having a nominal composition, in weight percent, of about 8 percent cobalt, about 14 percent chromium, about 3.3 percent molybdenum, about 3.5 percent tungsten, about 3.5 percent aluminum, about 2.5 percent titanium, about 3.5 percent niobium, about 0.05 percent zirconium, about 0.07 percent carbon, about 0.01 percent boron, balance nickel and minor elements.

The nickel-base superalloys may be furnished in any operable form, such as cast-and-wrought or consolidated-powder billets. Consolidated-powder billets are preferred. These billets are made by consolidating powders of the selected superalloy by extrusion or other operable process. Consolidated-powder billets have the advantage over cast-and-wrought billets in having a finer, more uniform microstructure and are therefore preferred for achieving good chemical uniformity, achieving good homogeneity of the forging, and minimizing sites for crack initiation.

The forging blank has a size and shape selected so that, after forging, the forging is of the desired size and shape. Procedures are known in the art for selecting the size and shape of the starting forging blank so as to yield the required finished size and shape.

Figure 2:
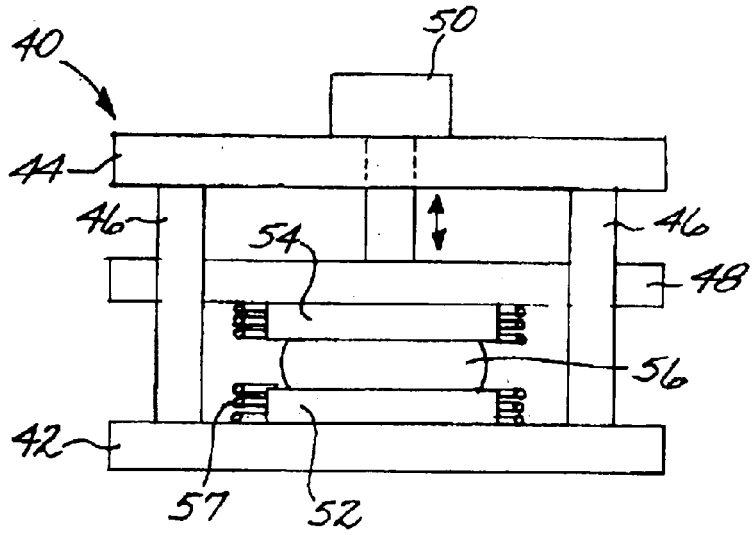
FIG. 2 is a schematic elevational view of a forging press and an article being forged.

A forging press and forging dies are provided, step 22. Any operable forging press may be used, and FIG. 2 schematically depicts a basic forging press 40. The forging press 40 has a stationary lower platen 42, a stationary upper plate 44, and stationary columns 46 that support the upper plate 44 from the lower platen 42. A movable upper platen 48 slides on the columns 46, and is driven upwardly and downwardly by a drive motor 50 on the upper plate 44. A lower forging die 52 is stationary and sits on the lower platen 42. An upper forging die 54 is movable and is affixed to the upper platen 48 so that it rides upwardly and downwardly with the upper platen 48. The forging blank 56 is positioned between the upper forging die 54 and the lower forging die 52. A heater 57, here illustrated as an induction heating coil, is positioned around the forging dies 52 and 54 to aid in maintaining the forging dies within the desired forging-die temperature range during the forging stroke, if desired. Temperature variations of the dies 52 and 54 are permitted during the forging stroke, but in general the forging dies 52 and 54 remain within the specified forging-die temperature range.

Figure 3:
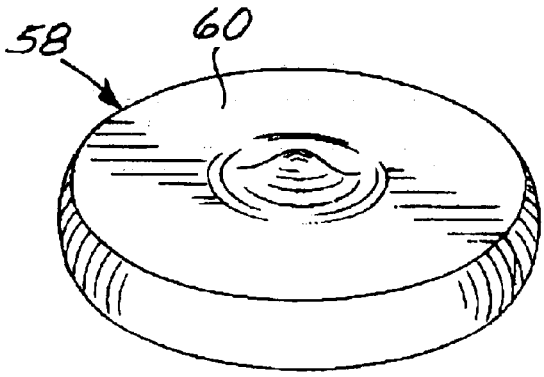
FIG. 3 is a schematic perspective view of a forging.

The forging blank 56 is positioned between the upper forging die 54 and the lower forging die 52 and is compressively deformed at a nominal strain rate by the movement of the upper forging die 54 in the downward direction. The upper forging die 54 and the lower forging die 52 may be flat plates, or they may be patterned so that the final forging has that pattern impressed thereon. FIG. 3 is an exemplary forging 58 with a patterned face 60 produced using patterned forging dies.

The forging dies 52 and 54 are made of a die nickel-base superalloy, wherein the die nickel-base superalloy has a creep strength of not less than a flow stress of the forging nickel-base superalloy at their respective temperatures and nominal strain rates during the forging operation. Any operable nickel-base superalloy may be used as the die nickel-base superalloy. Preferably, the forging dies 52 and 54 are preferably made with a nominal composition, in weight percent, of from about 5 to about 7 percent aluminum, from about 8 to about 15 percent molybdenum, from about 5 to about 15 percent tungsten, up to about 140 parts per million magnesium (preferably about 140 parts per million magnesium), no rare earths, balance nickel and impurities The forging blank 56 is heated to a forging-blank starting temperature of from about 1850° F. to about 1950° F., preferably about 1900° F., step 24. The forging-blank starting temperature may not be less than about 1850° F., because of the excessively high flow stress of the forging blank at lower temperatures. The forging-blank starting temperature may not be greater than about 1950° F., because the desired finished microstructure of the forging is not achieved. The heating step 24 is preferably performed in air in an oven.

The forging dies 52 and 54 are heated to a forging-die starting temperature of from about 1500° F. to about 1750° F., preferably about 1700° F., step 26. The forging-die starting temperature may not be less than about 1500° F., because the contact of the forging dies 52 and 54 to the forging blank 56 in the subsequent step will cause the forging blank 56 to crack at its surface. The forging-die starting temperature may not be greater than about 1750° F., because at higher temperatures the material of the forging dies loses its strength so that it is no longer operable to accomplish the forging. The heating step 26 is preferably performed in air by induction heating of the forging dies 52 and 54 in place in the forging press 40.

The forging blank is placed between the forging dies 52 and 54 in the manner illustrated in FIG. 2, step 28.

The forging blank is forged using the forging dies 52 and 54, step 30. The forging step 30 is preferably performed in air. The forging nominal strain rate is preferably greater than about 0.02 per second. The forging nominal strain rate is desirably this high to achieve the preferred grain structure. The "nominal" strain rate is that determined from the gross rate of movement of the upper platen 48, normalized to the height of the forging blank 56 measured parallel to the direction of movement of the upper platen 48. Locally within the forging, the actual strain rate may be higher or lower.

At the beginning of the forging step 30, the forging blank is at the forging-blank starting temperature and the forging dies 52 and 54 are at the forging-die starting temperature. The forging blank tends to cool slightly and the forging dies tend to heat slightly at their contact locations, and both the forging blank and the forging dies tend to cool elsewhere as they lose heat to the surrounding ambient air. However, the temperature change during the forging step 30 is not large, because the forging is performed rapidly. The forging dies 52 and 54 are optionally but desirably heated by the heater 57 to ensure that they are within the forging-die starting temperature range during the entire forging step 30.

The forging step 30 is not isothermal, in that the forging blank 56 is in one temperature range, and the dies 52 and 54 are in another temperature range. It is also typically not at a constant strain rate. In performing the forging step 30, the forging press is operated at as high a rate of movement of the upper platen 48 as possible, without increasing the load on the forging dies 52 and 54 above their permitted creep level that would result in permanent deformation of the forging dies.

The heating steps 24 and 26 and the forging step 30 are preferably performed in air. The forging in air greatly reduces the cost of the forging operation as compared with forging in vacuum or in an inert atmosphere, as required in prior processes for forging the nickel-base superalloys. The careful selection of the die materials and temperature range, and the temperature range of the forging during the forging operation ensures that the desired structure is obtained in the forging, and that the forging may be performed in air without damaging either the forging dies 52 and 54, or the forging blank 56, due to excessive oxidation.

After the forging operation of step 30 is complete, the forging 58 is removed from the forging press 40. The forging 58 may be used in the as-forged state, or it may be post processed, step 32. In the preferred case, the forging of Rene™ 95 alloy is not annealed at a temperature above the gamma-prime solvus temperature. Instead, the forging may be annealed at an annealing temperature below the gamma-prime solvus temperature, such as about 2030° F. in the case of the Rene™ 95 alloy. Other types of post-processing 32 include, for example, cleaning, other types of heat treating, additional metalworking, machining, and the like.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for forging a superalloy, comprising the steps of providing a forging blank of a forging nickel-base superalloy;

providing a forging press having forging dies made of a die nickel-base alloy;

heating the forging blank to a forging-blank starting temperature of from about 1850° F. to about 1950° F.;

heating the forging dies to a forging-die starting temperature of from about 1500° F. to about 1750° F.;

placing the forging blank into the forging press and between the forging dies; and forging the forging blank at the forging-blank starting temperature using the forging dies at the forging-die starting temperature, to produce a forging.

2. The method of claim 1, wherein the step of providing the forging blank includes the step of providing the forging blank having a nominal composition, in weight percent, of about 8 percent cobalt, about 14 percent chromium, about 3.3 percent molybdenum, about 3.5 percent tungsten, about 3.5 percent aluminum, about 2.5 percent titanium, about 3.5 percent niobium, about 0.05 percent zirconium, about 0.07 percent carbon, about 0.01 percent boron, balance nickel and minor elements.

3. The method of claim 1, wherein the step of providing the forging blank includes the step of providing the forging blank as consolidated powder.

4. The method of claim 1, wherein the step of providing the forging press includes the step of providing the forging dies having a nominal composition, in weight percent, of from about 5 to about 7 percent aluminum, from about 8 to about 15 percent molybdenum, from about 5 to about 15 percent tungsten, up to about 140 parts per million magnesium, no rare earths, balance nickel and impurities.

5. The method of claim 1, wherein the step of heating the forging blank and the step of heating the forging dies include the step of heating the forging blank and the forging dies in air.

6. The method of claim 1, wherein the step of forging includes the step of forging the forging blank and the forging dies in air.

7. The method of claim 1, wherein the step of heating the forging blank includes the step of heating the forging blank to the forging-blank starting temperature of about 1900° F. and wherein the step of heating the forging dies includes the step of heating the forging dies to the forging-die starting temperature of about 1700° F.

8. The method of claim 1, wherein the step of forging includes the step of forging the forging blank at a forging nominal strain rate of greater than about 0.02 per second.

9. The method of claim 1, wherein there is no supersolvus annealing of the forging, after the step of forging.

10. The method of claim 1, wherein the step of forging includes the step of forging the forging blank into a forging which is a precursor of a gas turbine engine component.

11. A method for forging a superalloy, comprising the steps of providing a forging blank of a nickel-base alloy consolidated powder;

providing a forging press having forging dies made of a die nickel-base superalloy;

heating the forging blank in air to a forging-blank starting temperature of from about 1850° F. to about 1950° F.;

heating the forging dies in air to a forging-die starting temperature of from about 1500° F. to about 1750° F.;

placing the forging blank into the forging press and between the forging dies; and forging the forging blank at the forging-blank starting temperature using the forging dies at the forging-die starting temperature, in air, and at a nominal strain rate of greater than about 0.02 per second, to produce a forging which is a precursor of gas turbine engine component.

12. The method of claim 11, wherein the step of providing the forging blank includes the step of providing the forging blank having a nominal composition, in weight percent, of about 8 percent cobalt, about 14 percent chromium, about 3.3 percent molybdenum, about 3.5 percent tungsten, about 3.5 percent aluminum, about 2.5 percent titanium, about 3.5 percent niobium, about 0.05 percent zirconium, about 0.07 percent carbon, about 0.01 percent boron, balance nickel and minor elements.

13. The method of claim 11, wherein the step of providing the forging press includes the step of providing the forging dies having a nominal composition, in weight percent, of from about 5 to about 7 percent aluminum, from about 8 to about 15 percent molybdenum, from about 5 to about 15 percent tungsten, up to about 140 parts per million magnesium, no rare earths, balance nickel and impurities.

14. The method of claim 11, wherein the step of heating the forging blank includes the step of heating the forging blank to the forging-blank starting temperature of about 1900° F., and wherein the step of heating the forging dies includes the step of heating the forging dies to the forging-die starting temperature of about 1700° F.

15. The method of claim 11, wherein there is no supersolvus annealing of the forging, after the step of forging.

16. The method of claim 1, including an additional step, after the step of forging, of annealing the forged forging blank at an annealing temperature below a gamma-prime solvus temperature of the nickel-base superalloy.

17. The method of claim 11, including an additional step, after the step of forging, of annealing the forging at an annealing temperature below a gamma-prime solvus temperature of the nickel-base superalloy.

* * * * *